United States Patent [19]

Zeleny

[11] 4,139,027

[45] Feb. 13, 1979

[54] JACQUARD MACHINE FOR A WEAVING MACHINE

[76] Inventor: Klaus Zeleny, Birnauer Strasse 11, D-775 Constance, Fed. Rep. of Germany

[21] Appl. No.: 828,420

[22] Filed: Aug. 29, 1977

[30] Foreign Application Priority Data

Sep. 2, 1976 [CH] Switzerland ..... 11127/76

[51] Int. Cl.[2] ..... D03C 3/16; D03C 3/20

[52] U.S. Cl. ..... 139/59; 139/319; 139/331

[58] Field of Search ..... 139/59-65, 139/317, 319, 331; 66/154 R, 154 A

[56] References Cited

U.S. PATENT DOCUMENTS

| | | | |
|---|---|---|---|
| 604,299 | 5/1898 | Carver | 139/319 |
| 3,472,287 | 10/1969 | Ribler | 139/319 |

FOREIGN PATENT DOCUMENTS

| | | | |
|---|---|---|---|
| 12111 of | 1900 | United Kingdom | 139/319 |
| 238203 | 8/1926 | United Kingdom | 139/319 |

*Primary Examiner*—James Kee Chi

*Attorney, Agent, or Firm*—Kenyon & Kenyon, Reilly, Carr & Chapin

[57] ABSTRACT

The Jacquard machine employs a selector system for blocking and un-blocking the pressers (e.g. Jacquard needles) wherein use is made of a control means comprised of two electrically magnetizable relatively movable rods. Upon energization of a magnetic field generator, the rods move away from each other so that one of the rods is moved into a blocking position relative to a presser needle. Upon de-energization of the magnetic field generator, the rods come together so that the presser needle is unblocked.

9 Claims, 10 Drawing Figures

Fig.8
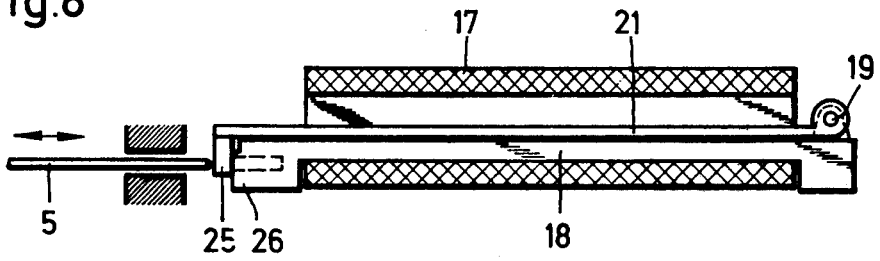
Fig.9
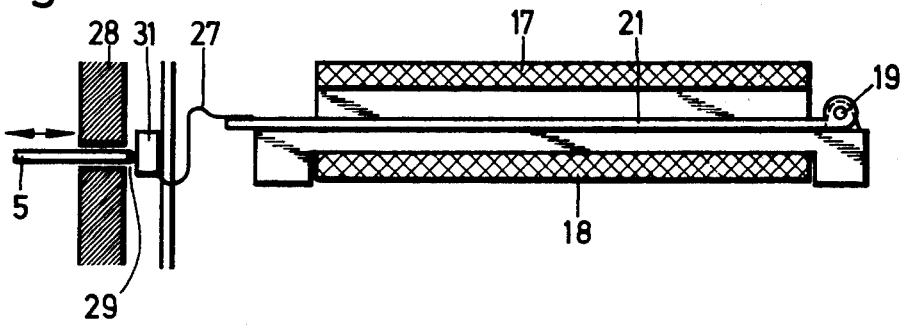
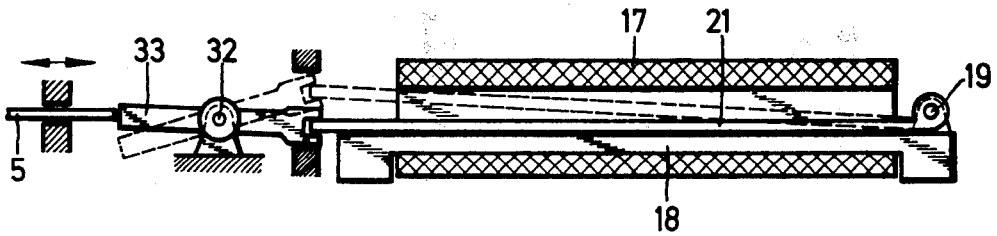
Fig.10

JACQUARD MACHINE FOR A WEAVING MACHINE

This invention relates to a Jacquard machine and, more particularly, to a Jacquard selection system.

As is known, various types of Jacquard machines have been used for controlling the warp yarns of a weaving machine. For example, U.S. Pat. Nos. 3,871,415 and 3,828,826 each describe a Jacquard mechanism employing control elements such as multi-morphous elements which are movable into blocking and non-blocking positions to control the position of a lifting hook. These multi-morphous elements are in the nature of flexible strips which can be deformed automatically by electrostriction or magnetostriction. However, in systems where the bending element experiences heavy stressing when sensed directly by a Jacquard needle or presser, the bending elements tend to break because of the brittleness of the material from which the elements are made. In order to overcome this problem, it has been known to provide a means between a bending element and a presser which can be moved by the bending element into a blocking or non-blocking position relative to the presser while at the same time transferring the force imposed by a presser in the blocking position into a casing or housing. Such a construction is described in U.S. patent application Ser. No. 654,784, filed Feb. 3, 1976. In this case, use is generally made of a slider which is disposed in a guideway or a casing in order to be pushed against a wall of the guideway by a presser when moved into the blocking position by a bending element. Generally, the sliders are loosely received within the guideway. Thus, fabrication of these selector mechanisms can become cumbersome particularly when placing and maintaining the individual sliders in the proper place.

Accordingly, it is an object of the invention to provide a Jacquard machine which has an improved selector mechanism.

It is another object of the invention to provide a Jacquard machine in which the force of a presser in a blocked condition is directly transferred to the selection system of relatively strong construction.

Briefly, the invention provides a Jacquard selection system for a Jacquard machine having a plurality of presser needles for programming a plurality of lifting hooks for controlling the warp yarns of a weaving machine and a presser needle drive at one end of the presser needles for moving the presser needles in a given direction. The selection system is disposed at an opposite end of the presser needles from the drive for selectively inhibiting the movement of the presser needles in accordance with a weave program.

The selection system incudes a plurality of control means for controlling the movement of each presser needle. Each control means includes a magnetic field generator i.e. an electrical coil and two electrically magnetizable rods which act as control elements. These rods are disposed substantially co-axially in the coil and adapted to be attracted towards and repelled from one another in dependence on the field of the generator into one of two positions. In one position, one of the rods blocks movement of a respective presser needle while, in the other position, this rod allows movement of the presser needle.

Experiments have shown that a control means of this construction and comprising electrically magnetizable rods is very satisfactory for use in a Jacquard machine since the moving control elements can be made of ferromagnetic materials such as steel, which are very strong and not likely to fracture. Since the magnetizable members are in rod form, the control means can be given a slim elongated shape. As such, the control means is particularly suitable for use in large numbers for a Jacquard machine where, of course, the number of control means must correspond to the number of threads being controlled. Since the power required to operate each magnetic field generator will be low, power consumption and the associated heat dissipation are correspondingly low.

These and other objects and advantages of the invention will become more apparent from the following detailed description and appended claims taken in conjunction with the accompanying drawings in which:

FIG. 8 illustrates a further modified control means according to the invention;

FIG. 9 illustrates a still further modified control means according to the invention; and FIG. 10 illustrates a still further modified control means according to the invention.

Figure 1:
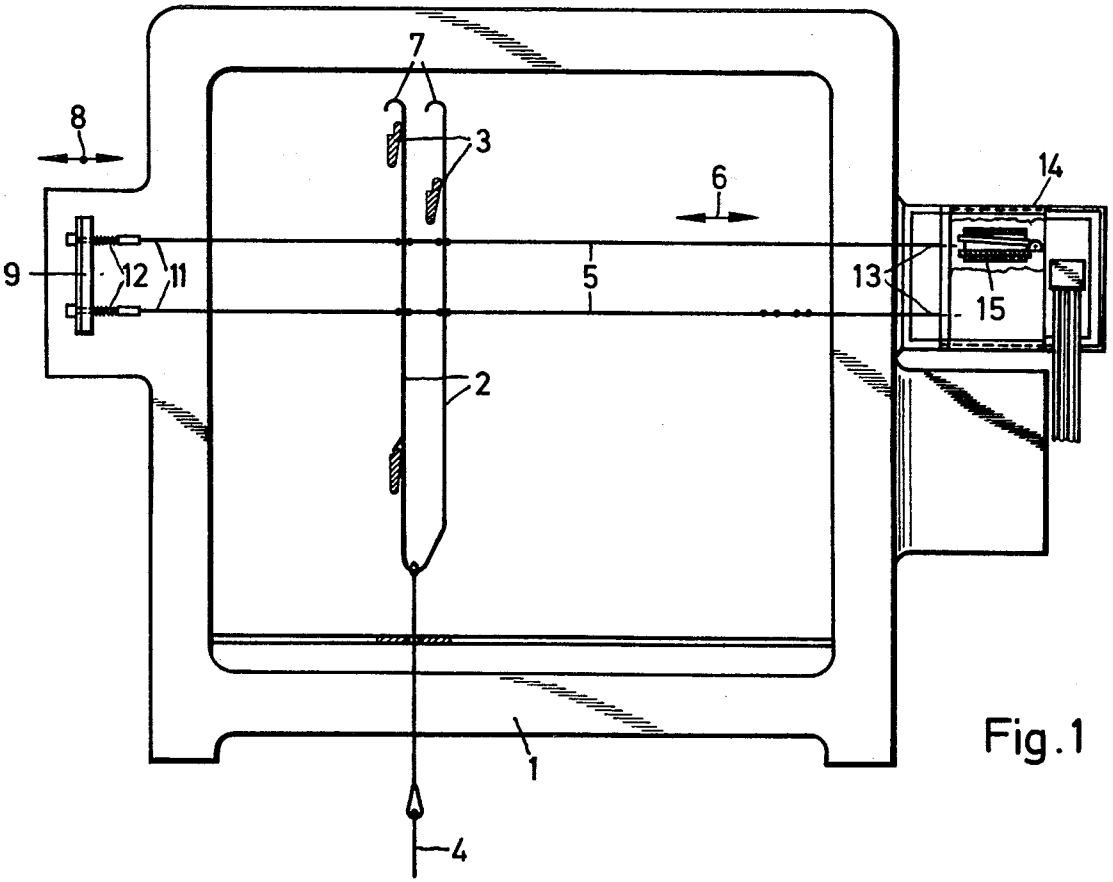
FIG. 1 illustrates a diagrammatic view in side elevation of a Jacquard machine according to the invention.

Referring to FIG. 1, the Jacquard machine has a frame 1 in which a plurality of lifting hooks 2 are disposed for coupling with various draw knives 3 as is known. The lifting hooks 2 are secured to warp healds 4 of a weaving machine (not shown) below the Jacquard machine so as to control the movement of the warp yarns into top shed and bottom shed positions. The hooks 2 are pressed by horizontal pressers or Jacquard needles 5 as indicated by the double arrow 6 so that nebs 7, which are on the hooks 2 are, for instance, placed beyond or within the range of the draw knives 3.

The Jacquard machine also has a presser needle drive at one end of the pressers 5 for moving the pressers 5 in a given direction. As indicated, the presser needle drive is formed by a rake or comb 9 which reciprocates as indicated by a double arrow 8. In addition, springs 12 are provided at the left hand ends 11 of the presser needles 5, as viewed, where the rake 9 strikes the pressers 5.

The Jacquard machine also has a selection system 14 at the opposite end of the presser needles 5 for selectively inhibiting the movement of the presser needles 5 in the direction indicated by the arrows 6 in accordance with a weave program. As indicated, the selection system 14 is located at the right hand end 13 of the presser needles 5 and includes a plurality of control means 15 of slim elongated shape for controlling the movement of each presser needle 5.

Figure 2:
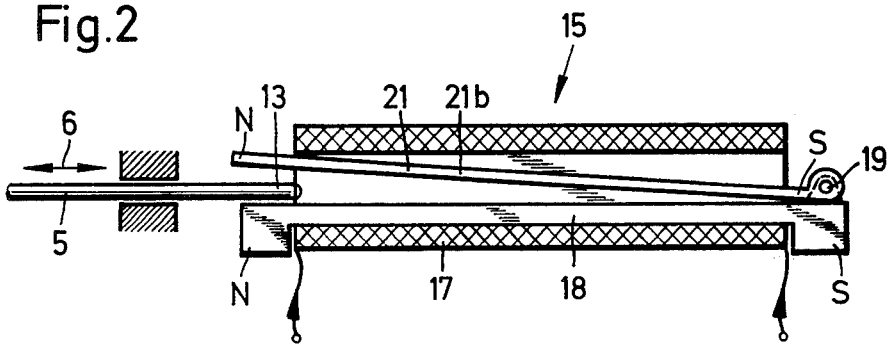
FIG. 2 illustrates an enlarged view of a control means according to the invention in a non-blocking position.
Figure 3:
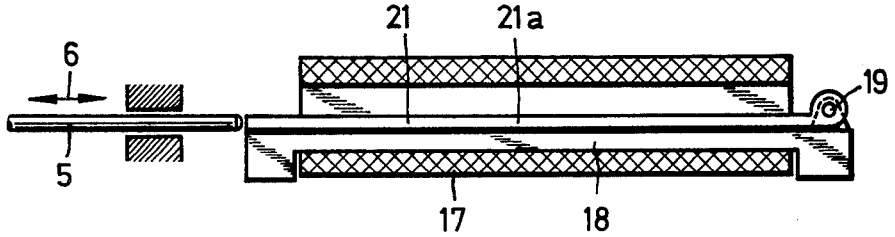
FIG. 3 illustrates a view of the control means of FIG. 2 in a blocking position.

Referring to FIGS. 2 and 3, each control means 15 is disposed within a casing of the selection system 14 opposite to a presser needle end 13 which slides within a suitable bore of the casing as shown.

Referring to FIG. 2, each control means comprises an electrical winding 17, a first ferromagnetic rod 18 which is fixed in the winding 17 and which is made, for example, of steel (high remanence = residual magnetism) and a second magnetizable ferromagnetic rod 21 which is pivoted to the first rod 18 at a place 19 to pivot upwards and which is made, for example, of soft iron (low remanence). When the winding 17 is energized, the two rods 18, 21 (which act as control elements for a needle 5) are polarized in the same sense, e.g. with the north pole on the left in both cases and with the south pole on the right in both cases, so that the two rods 18, 21 repel one another. The rod 21 therefore moves from a normal position 21*a* as shown in FIG. 3 into a pivoted-out position 21*b* as shown in FIG. 2. With the rod 21 in the position 21*a* shown in FIG. 3, the associated presser needle 5 when moved by the rake 9 abuts the rod 21 (blocking of pressing movement), the spring 12 being compressed. With the rod in the position 21*b* shown in FIG. 2, the presser needle 5 can be moved to the right, the end 13 of the presser 5 entering the space between the two rods 18, 21. Movement of the presser needle 5 produces movement of the associated lifting hook 2. When the winding 17 is de-energized, the high remanence of the rod 18 predominates over the low remanence of the rod 21 so that the two rods 18, 21 are attracted toward one another and the rod 21 descends very rapidly.

Figure 4:
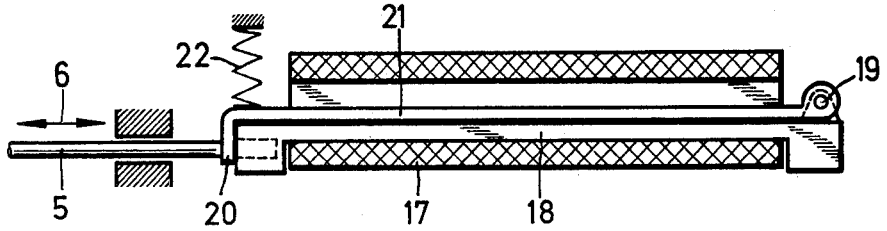
FIG. 4 illustrates a modified control means in accordance with the invention.

Referring to FIG. 4, wherein like reference characters indicate like parts as above, he electromagnetic control means may alternatively use two rods 18, 21 which are made of the same ferromagnetic material so that they both have the same remanence. In this case, the free end of the rod 21 has a downwardly bent part 20 which overlaps the rod 18 when in the blocking position. Also, a return compression spring 22 is provided to ensure a rapid descent of the rod 21 from a raised unblocking position (not shown) to the blocking position shown. As indicated, the stationary rod 18 has a bore or slot to accommodate the movement of the presser needle 5.

Figure 5:
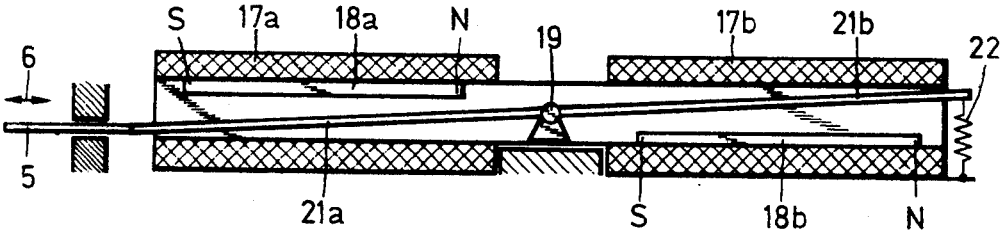
FIG. 5 illustrates a view of a further modified control means in accordance with the invention.

Referring to FIG. 5, the control means may also have two windings 17*a*, 17*b* and two stationary armature rods 18*a*, 18*b*. One rod 18*a* is mounted in one winding 17*a* at the top thereof and the other rod 18*b* is mounted in the other winding 17*b* at the bottom thereof. A pivot 19 is disposed centrally and has two ferromagnetic rods 21*a*, 21*b* mounted thereon. These rods 21*a*, 21*b* are magnetically insulated from one another and are made of ferromagnetic material having the same remanence. In the position shown, the windings 17*a*, 17*b* are in the energized state so that a presser needle 5 is blocked. The rods 18*b*, 21*b* intensify the changeover. When the windings 17*a*, 17*b* are de-energized, a tension spring 22 moves the rods 21*a*, 21*b* into the other position in which the presser needle 5 can reach the pressing position in which the presser 5 extends into the space inside the winding 17*a*.

Figure 6:
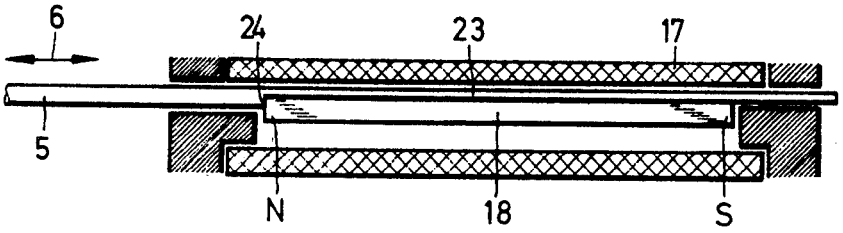
FIG. 6 illustrates a further modified control means in accordance with the invention in a blocking position.
Figure 7:
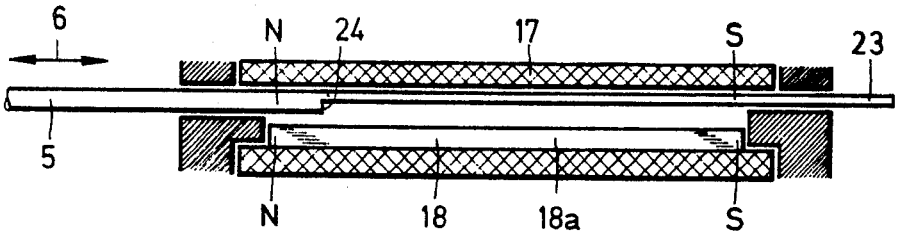
FIG. 7 illustrates a view of the control means of FIG. 6 in a non-blocking position.

Referring to FIG. 6, a presser needle 5 may also be made a part of the control means. In this case, the presser needle 5 has a shoulder 24 and a free end portion 23 which extends through the winding 17 and serves as one magnetizable rod of the control means. The second rod 18 is a permanent magnet. When no current flows through the winding 17, the second rod 18 moves into the blocking position, as shown in FIG. 6 and is engaged by the shoulder 24. With the second rod 18 in this position, the presser 5 cannot move into the position to press the respective lifting hook 2. Such a movement can occur only when the winding 17 is in the energized state, i.e., when the members 23, 18 become polarized in the same sense so that they repel one another and the rod 18 drops into the inoperative unblocking position 18*a* shown in FIG. 7.

Referring to FIG. 8, wherein like reference characters indicate like parts as above, the movable rod 21 of a control means may have a blocking shoe 25 which may be slidably mounted on the rod 21 and which, when pressed by the presser needle 5, bears on a stationary part 26 of the rod 18. In this way, the stationary part 26 receives the pressure rather than the movable rod 21.

Referring to FIG. 9, wherein like reference characters indicate like parts as above, the control means may have a spring 27 mounted on the end of the rod 21 and a slider 31 movable in a guide 28 with a clearance 29 secured to the spring 27. The slider 31 is disposed to receive the pressure from the presser needle 5 and to transfer the pressure to the guide 28 when the rod 21 is in the blocking position as shown. When the rod 21 is moved into the non-blocking position (not shown), the slider 31 is also moved out of the path of the presser needle 5.

Referring to FIG. 10, wherein like reference characters indicate like parts as above, the control means may also cooperate with a blocking lever 33 pivoted on a pivot mounting 32 and disposed between the rod 21 and the presser needle 5. In this construction, the pressure of the needle 5 is transmitted by the lever 33 to the pivot mounting 32 when the rod 21 is in the blocking position shown in solid lines. When the rod 21 is moved into the unblocking position as shown in dotted lines, the lever 33 is pivoted into an unblocking position also, as shown in dotted lines, due to an interengagement between the rod 21 and lever 33.

We claim:

1. A Jacquard Machine for a weaving machine comprising a plurality of lifting hooks;

a plurality of reciprocally movable presser needles for moving said lifting hooks;

a plurality of control means for controlling movement of each presser needle, each said control means including an energizable electrical coil and two electrically magnetizable rods disposed substantially coaxially within said coil, said rods being adapted to be attracted towards and repelled from one another in dependence on the field of said coil into one of two positions, whereby in one of said positions one of said rods blocks movement of a respective presser needle and in the other of said positions said one rod allows movement of a respective presser needle.

2. A Jacquard machine as set forth in claim 1 wherein one of said rods is pivoted relative to the other of said rods.

3. A Jacquard machine as set forth in claim 1 which further comprises a return spring connected to one of said rods for moving said one rod from one of said positions to the other of said positions upon de-energization of said coil.

4. A Jacquard machine as set forth in claim 1 wherein one of said rods is integral with a respective presser needle to reciprocate therewith, said one rod having an abutment thereon, and wherein the other of said rods is permanently magnetized and is movable into the path of said abutment upon de-energization of said field.

5. A Jacquard machine as set forth in claim 1 which further comprises a stationary element in said control means and a blocking shoe mounted on said one rod for disposition between said respective presser needle and said stationary element with said one rod in one of said positions.

6. A Jacquard machine as set forth in claim 5 wherein said blocking member is a shoe slidably mounted longitudinally of said one rod.

7. A Jacquard machine as set forth in claim 5 wherein said stationary element is a guide and said blocking member is slidably mounted transversely of said one rod in said guide.

8. A Jacquard machine comprising a plurality of presser needles for programming a plurality of lifting hooks controlling warp yarns of a weaving machine;

a presser needle drive at one end of said presser needles for moving said presser needles in a given direction; and a selection system at an opposite end of said presser needles for selectively inhibiting the movement of said presser needles in said direction in accordance with a weave program, said selection system including a plurality of control means, each said control means including an energizible electrical coil and two electrically magentizable rods disposed substantially coaxially within said coil, said rods being adapted to be attracted towards and repelled from one another in dependence on the field of said coil into one of two positions, whereby in one of said positions one of said rods blocks movement of a respective presser needle and in the other of said positions said one rod allows movement of a respective presser needle.

9. In a Jacquard selection system, the combination comprising a casing;

a presser needle movably mounted relative to said casing for moving into one of a sensing position and a nonsensing position;

a control means within said casing for selectively inhibiting movement of said presser needle into said non-sensing position, and means including an energizable electrical coil and two electrically magnetizable rods disposed substantially coaxially within said coil, said rods being adapted to be attracted towards and repelled from one another in dependence on the field of said coil into one of two positions, whereby in one of said positions one of said rods blocks movement of a respective presser needle and in the other of said positions said one rod allows movement of a respective presser needle.

* * * * *